United States Patent [19]

Houser

[11] Patent Number: 4,881,916

[45] Date of Patent: Nov. 21, 1989

[54] DISPLAY BALLOON HOLDER

[75] Inventor: Dan B. Houser, Deerfield, Ill.

[73] Assignee: RTC Industries, Inc., Chicago, Ill.

[21] Appl. No.: 180,181

[22] Filed: Apr. 11, 1988

[51] Int. Cl.[4] ..... A63H 3/06

[52] U.S. Cl. ..... 446/222; 446/220

[58] Field of Search ..... 446/220–224; 24/305 R, 305 S

[56] References Cited

U.S. PATENT DOCUMENTS

| | | | |
|---|---|---|---|
| 2,882,645 | 4/1959 | Stivers | 446/222 |
| 3,892,081 | 7/1975 | Goral | 446/220 |
| 4,661,081 | 4/1987 | Basseches | 446/222 |
| 4,715,841 | 12/1987 | Nelson et al. | 446/222 |
| 4,798,554 | 1/1989 | Nelson et al. | 446/222 |

FOREIGN PATENT DOCUMENTS

| | | | |
|---|---|---|---|
| 2093709 | 9/1982 | United Kingdom | 446/222 |

*Primary Examiner*—Richard J. Apley
*Assistant Examiner*—J. Welsh
*Attorney, Agent, or Firm*—Dressler, Goldsmith, Shore, Sutker & Milnamow, Ltd.

[57] ABSTRACT

A two-piece assembly for the operational holding of a display balloon in the inflated state. One piece comprises a male member cylindrical receptacle having slots for facilitating the positioning of the balloon neck therein. A cleat depends integrally from the bottom wall of the male member and the balloon neck is wrapped therearound to retain and constrict it and tend to prevent the escape of gas from the balloon. A female member receptacle of complementary configuration is resiliently snap-fittable over the male member to conceal and shield the operationally positioned balloon neck. The assembled holder is supportable as desired, such as in a tubular standard.

6 Claims, 1 Drawing Sheet

DISPLAY BALLOON HOLDER

TECHNICAL FIELD

This invention relates to merchandising and advertising displays and, more particularly, to a holder for displaying an inflated balloon.

BACKGROUND OF THE INVENTION

Modern merchandising methods utilize a broad variety of visual devices for attracting the interest of the consumer. Particularly within and around self-serve and "super" stores like food markets, departments stores, beverage markets, and the like, one is likely to encounter floor, shelf and point of purchase displays including placards, posters, banners, photographs, signs, and also balloons.

For a display balloon to have its intended effect it must, of course, be inflated. Maintenance of the inflated state of a display balloon becomes even more important if the balloon carries artwork or other advertising indicia on its surface. Typically, balloons are inflated by mouth or pump and a knot is tied in the neck, or the neck is otherwise tied, or sealed, to prevent escape of the inflating gas therefrom. The balloon neck may then be tied or stapled to a stick or other supporting surface for display purposes. With that type of closure and mounting it is difficult, if not impossible, to re-inflate the balloon if the same becomes deflated or undesirably limp. Moreover, the tying of a sufficiently tight knot in the neck of an inflated balloon requires some degree of manual dexterity and may even result in the tearing or destruction of the balloon.

There thus exists a need for a device capable of holding and displaying a balloon in its inflated condition. Such a holder should be simple to use, non-injurious to the balloon and inexpensive to manufacture so that it may be discarded after a single use if desired.

SUMMARY OF THE INVENTION

The present invention provides a holder for inflated balloons that is simple to use and most efficient in operation. The inventive holder eliminates the need for tying knots in or otherwise constricting the neck of the inflated balloon and may be inexpensively fabricated as a throw-away device.

Briefly, the invention comprises an assembly having cooperating male and female members. The male member is a receptacle for the balloon and comprises a tubular structure having a bottom wall and a tapered slot formed in a sidewall thereof, with said slot extending partially into the bottom wall. A pair of ears and a post depend from the bottom wall and are adapted to function as a cleat or construction means for the neck of a balloon. In operation, an inflated balloon may be readily inserted into the male member by drawing the neck of the balloon through the slot and then wrapping or tying the free end of the neck around the cleat.

The cooperating female member comprises a closed-bottom tubular structure of complementary configuration and adapted to receive the male member therein. the outer wall of the female member and the inner wall of the male member are provided with cooperating frictional engagement means whereby the male may be simply snap-fit into the female. When the holder is assembled, the inflated balloon is efficiently supported with the neck of the balloon protected against external destructive forces. The assembled holder is then supportable in any desired manner, such as, by press-fitting the male member into a complementarily shaped tube, or the like.

Preferably, the male and female members of the assembly are cylindrical in form, although other shapes, such as ovate or polygonal, may likewise be employed as will become apparent from the following description of a preferred embodiment of the invention.

Numerous other advantages and features of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts throughout.

DETAILED DESCRIPTION OF THE INVENTION

Figure 1:
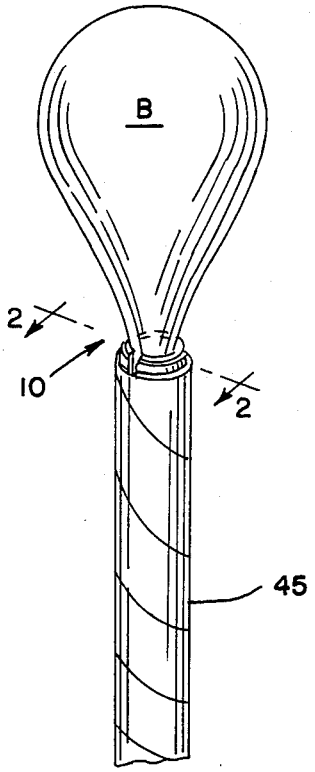
FIG. 1 is a perspective view of a display balloon holder embodying the principles of the invention and illustrating the same operationally retaining an inflated balloon and being mounted in a tubular support standard.
Figure 3:
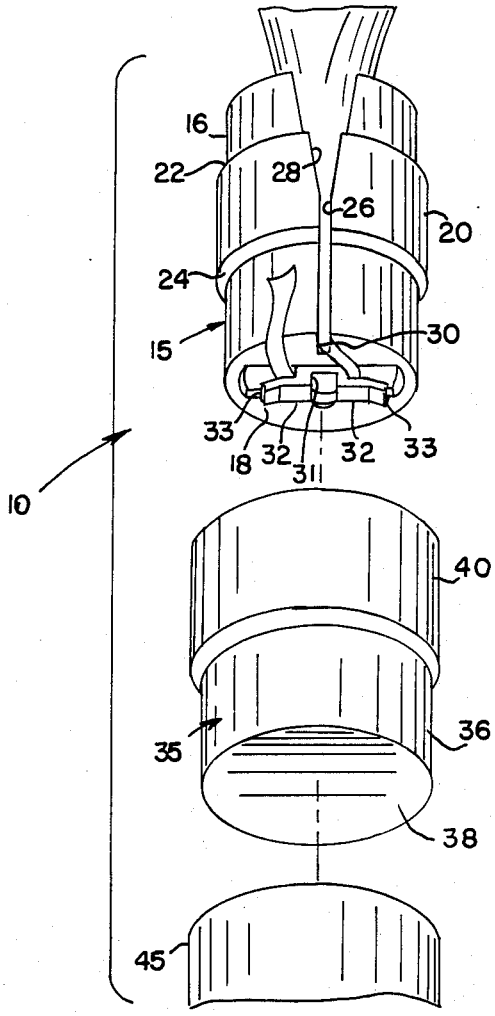
FIG. 3 is a further enlarged exploded perspective view.

Referring with greater particularity to the figures of the drawings, the reference numeral 10 indicates generally a display balloon holder embodying the principles of the invention. Balloon holder 10 comprises an assembly having a male member 15, providing a receptacle for a balloon B, and a female member 35. Each of the members 15 and 35 may be integrally molded of inexpensive plastics and is adapted for resilient cooperative assembly in the manner to be described.

The male member 15 comprises an open-topped cylinder having a sidewall 16 and a bottom wall 18. Sidewall 16 includes an enlarged diameter portion 20 intermediate the length thereof and providing shoulders 22 and 24. A vertical slot 26 is formed in the sidewall 16 and said slot tapers outwardly, as at 28, and opens to the top edge of said sidewall 16. Bottom wall 18 is likewise formed with a short slot 30 projecting inwardly from the sidewall 16 and communicating with the vertical slot 26.

Depending from the bottom wall 18 are a central post 31 and a pair of opposed ears 32,32 projecting outwardly therefrom, said posts including a downwardly tapering segment 33. Barb-like prjections 34,34 are formed on the upper surface of the ears 32, and it will be noted that the ears 32 lie in close proximity to the plane of the bottom wall 18 for reasons which will become apparent as the description proceeds.

Figure 2:
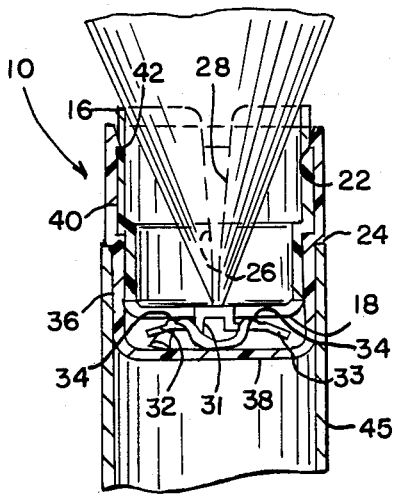
FIG. 2 is an enlarged vertical sectional view on the plane of line 2—2 in FIG. 1.
Figure 4:
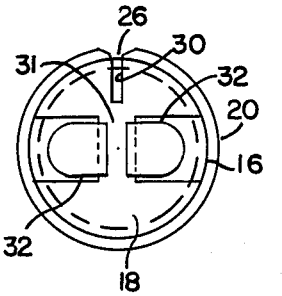
FIG. 4 is a bottom plan view of the male member of the balloon removed therefrom.

The female member 35 comprises an open-topped cylinder of complementary configuration having a sidewall 36 and a bottom wall 38. The sidewall 36 comprises an upper enlarged diameter segment 40 adapted to receive therein the portion 20 of the male member 16 in snug, contour-accommodating relationship (see FIG. 2). An annular bead 42 is formed on the inner surface of the segment 40 and said bead is adapted to frictionally engage the shoulder 22 of the male member portion 20, as illustrated in FIG. 2. The materials of contruction of the members 15 and 35 afford a limited amount of resiliency to those members so that the male member may be readily pressed into the female member until the bead 42 snaps over and into engagement with the shoulder 22.

In operation, a balloon B may first be inflated to the desired pressure, or, alternatively, the balloon B may comprise a pre-inflated and sealed member. In either case, the flexible neck of the balloon is threaded into the male member 15 through the slots 26 and 30, said threading being facilitated by the outward taper 28 in the slot 26. The free end portion of the balloon neck is then wrapped snugly around the post 31, such wrapping being again facilitated by the tapering segments 33 of the ears 32. The ears 32, post 31, and barbs 34 thereupon function as a constricting cleat to tightly grip and retain the balloon neck and prevent the escape of gas therefrom. The holder 10 is then fully operationally assembled by pressing the male member down into the female member until the latter snaps into engagement as already described. Removal of the female member is also permissible, owing to its resiliency, in the event it is desired to re-inflate or to re-use the balloon.

Final display of the balloon B and holder 10 may be accomplished by supporting the holder 10 in any desired fashion. In the embodiment illustrated, the holder is press-fit into a tubular standard 45 sized to frictionally receive the female member 35. The standard 45 may be made of any suitable materials such as plastics or paperboard.

It will be appreciated from the foregoing detailed description of the invention and illustrative embodiment thereof that numerous variations and modifications may be effected without departing from the true spirit and scope of the novel concept of the principles of the invention.

What is claimed is:

1. A display holder for an inflated balloon comprising: a two-member assembly, a first member including a tubular receptacle having a vertical wall and a bottom wall, and slot means for facilitating the entry of the balloon neck into said receptacle, constricting means on said first member comprising a cleat depending from said bottom wall for gripping and operationally retaining the neck of the balloon, and a second member being frictionally engageable with said first member for concealing said constricting means and the neck of the balloon operationally positioned thereon.

2. A display holder according to claim 1 wherein said cleat comprises a central post and a pair of opposed ears integral with said bottom wall, said ears laying in close proximity to said bottom wall and cooperating therewith to tightly grip a balloon neck operationally positioned therebetween and around said post.

3. A display holder according to claim 2 comprising a barb projecting from the upper surface of each of said ears, said barbs cooperating with the post to operationally retain the balloon neck.

4. A display holder for an inflated balloon comprising:

A first cylindrical receptacle having an annular vertical wall and a bottom wall;

a vertical slot in said vertical wall and extending between the top edge thereof and said bottom wall;

a horizontal slot in said bottom wall communicating with said vertical slot;

cleat means depending integrally from said bottom wall, whereby the neck of a balloon is operationally positionable by inserting the same through said slots and into said receptacle and wrapping the free end thereof around said cleat means to constrict and retain it and prevent the escape of gas therefrom;

a second cylindrical receptacle of complementary configuration with said first receptacle and having an annular vertical wall and a bottom wall; and resilient means on said second receptacle for frictional engagement thereof over the bottom portions of said first receptacle.

5. A display holder according to claim 4 wherein said cleat means comprises a central post and a pair of opposed substantially horizontal ears, said ears lying substantially parallel to and in close proximity to said first receptacle bottom wall and having a barb projecting from the upper surface thereof.

6. A display holder according to claim 4 wherein the vertical wall of said first receptacle comprises an enlarged diameter segment and the vertical wall of said second receptacle comprises a complementary enlarged diameter segment, and said resilient means comprises an annular bead on the inner surface of said second receptacle enlarged diameter segment which is snap-fittable over the enlarged diameter segment of said first receptacle.

* * * * *